US005253704A

United States Patent [19]

Barrus et al.

[11] Patent Number: 5,253,704

[45] Date of Patent: * Oct. 19, 1993

[54] HIGH PRESSURE AUTOMATIC MUD SAVER VALVE

[75] Inventors: Reginald J. Barrus, Jefferson, La.; Donald J. Barrus, Los Alamintos, Calif.; Theodore A. Kritikos; John W. Owensby, both of New Orleans, La.

[73] Assignee: KOB, Inc., Gretna, La.

[ * ] Notice: The portion of the term of this patent subsequent to Nov. 13, 2007 has been disclaimed.

[21] Appl. No.: 611,797

[22] Filed: Nov. 13, 1990

Related U.S. Application Data

[63] Continuation-in-part of Ser. No. 410,889, Sep. 22, 1989, Pat. No. 4,969,513.

[51] Int. Cl.[5] ..... E21B 34/02

[52] U.S. Cl. ..... 166/53; 137/493; 166/326; 251/5

[58] Field of Search ..... 166/53, 54, 166, 316, 166/319, 320, 323, 326; 137/493, 843; 251/5; 100/211; 425/417; 156/285, 286

[56] References Cited

U.S. PATENT DOCUMENTS

| | | | |
|---|---|---|---|
| 3,494,588 | 2/1970 | Kisling, III | 251/5 |
| 3,552,712 | 1/1971 | Whitlock | 251/5 |
| 3,566,964 | 3/1971 | Livingston | 166/326 |
| 3,717,203 | 2/1973 | Kirkpatrick et al. | 166/326 X |
| 3,955,594 | 5/1976 | Snow | 137/493 |
| 4,349,204 | 9/1982 | Malone | 166/187 X |
| 4,494,345 | 1/1985 | Peterson | 251/5 X |
| 4,628,996 | 12/1986 | Arnold | 166/187 X |
| 4,768,590 | 9/1988 | Sanford et al. | 166/187 |
| 4,790,344 | 12/1988 | Chauvier et al. | 251/5 |
| 4,832,120 | 5/1989 | Coronado | 166/187 |

FOREIGN PATENT DOCUMENTS

| | | | |
|---|---|---|---|
| 1116169 | 11/1961 | Fed. Rep. of Germany | 166/326 |
| 907365 | 10/1962 | United Kingdom | 166/224 |

*Primary Examiner*—William P. Neuder
*Attorney, Agent, or Firm*—Wong & Husar

[57] ABSTRACT

The disclosure relates to an improved diaphragm type mud saver valve, commonly referred to as a Kelley valve, which closes automatically to prevent loss and spilling of drilling mud. The improved valve can withstand very high drilling and pump pulsation pressures, for example, the pressures required for drilling wells over 20,000 feet in depth and mud pressures can exceed 15,000 p.s.i. The disclosure prevents the formation of gas pockets by providing gas escape openings and a clearance space between the support and backup element to prevent the extrusion of the diaphragm material through the small openings in a backup sleeve thus extending the life of the diaphragm and allowing proper diaphragm seating.

7 Claims, 2 Drawing Sheets

HIGH PRESSURE AUTOMATIC MUD SAVER VALVE

This application is a continuation-in-part of our copending application Ser. No. 410,889, filed Sep. 22, 1989, and now U.S. Pat. No. 4,969,513.

This invention relates generally to a diaphragm type mud saver valve, often called a Kelley valve, which closes automatically to prevent loss and spilling of drilling mud, and particularly to an improved valve of this type which can withstand very high drilling mud pump pulsation pressures, for example, the pressures required for drilling wells over 20,000 feet deep, where mud pressures can be higher than 15,000 psi.

BACKGROUND OF THE INVENTION

In the drilling of wells, drilling mud is pumped through a Kelley or driver at a pressure sufficient to flow down through the interior of the drill string to the bit at the bottom of the string and then upwardly through the annulus between the string and the wall of the bore hole.

From time to time, the pump is stopped and the drill string is disconnected from the Kelley or driver, for example, to add or remove pipe sections from the string, or to replace the bit, which requires pulling the entire string. A considerable amount of drilling mud remains in the Kelley and can flow or drain from the lower end of the Kelley each time it is disconnected from the drill string.

Mud draining from the kelley often spills on the floor of the drilling rig and causes unsafe conditions for workmen, and can also cause pollution and environmental problems if the mud spills on the ground. Time is lost because it is usually necessary for the workmen to wait until the mud has drained from the kelley before another connection can be made to the drill string, and the mud lost is expensive.

Kelley or mud saver valves with a flexible tubular body or diaphragm, which opens in response to pump pressure, and closes automatically under the action of compressed fluid such as a pressurized gas, in a chamber surrounding the body are known, as described for example, in U.S. Pat. No. 4,303,100. While the valve of Patent 4,303,100 may operate satisfactorily when drilling relatively shallow wells of a few thousand feet, the diaphragm is damaged at the very high pump pressures required for deep drilling. Such high pump pressures extrude the diaphragm material through the small openings in the back up sleeve and the diaphragm either punctures or fastens itself to the backup sleeve so it will not close when pumping pressure is again released.

In our copending U.S. application Ser. No. 410,889, filed Sep. 22, 1989, the disclosure of which is incorporated herein by reference, a support for the diaphragm has openings facing the diaphragm, and there is a backup element behind the support. As the mud pressure increases, the diaphragm is forced toward the support, pressurized gas escapes through the openings and then through a small clearance space between the support and the backup element, and the diaphragm seats on the support. As pump pressure further increases, the diaphragm forces the support against the backup element to close the clearance space so the diaphragm material cannot extrude through the openings in the support.

Each time the mud pump is started, the mud pressure increases almost instantaneously to the full pumping pressure. When drilling a deep well, this pressure is several thousand psi, and the initially closed diaphragm is subjected to this very high pressure instantaneously and is slammed against the support. It is believed that from time to time, when the pump is started, the openings in the support are closed by the diaphragm before all the pressurized gas can escape from between the diaphragm and the support. The resulting gas pockets behind the diaphragm in the regions between the openings weaken the diaphragm. At high pump start-up pressures the diaphragm is believed to act like a flexible stopper which closes the openings before all the gas can escape. While the gas pockets can be minimized by increasing the number of openings, and/or changing the locations of the openings, additional machining is required, and a better solution has been found.

SUMMARY OF THE INVENTION

In accordance with the invention, gas pockets are avoided by providing gas escape openings which the diaphragm cannot fully close until after the diaphragm seats on the support.

In accordance with one aspect of the invention, the arrangement at the openings is such that the diaphragm is propped away from the openings to avoid complete closing until very high pump pressure acts on the diaphragm.

In accordance with another aspect of the invention, the openings communicating with the region behind the diaphragm take the form of a clearance space between inner and outer diaphragm support rings.

Simply stated, the gas escape openings act like a poppet valve with a head that spaces the diaphragm from the gas escape opening, but closes under the action of pump pressure so that the valve opening is always smaller than the space into which the diaphragm material can extrude.

In accordance with another aspect of the invention, the gas escape openings take the form of an annular space between inner and outer diaphragm support rings, which annular space is smaller than the space into which the diaphragm can extrude as a result of pump or well fluid pressure.

In accordance with another aspect of the invention, the rings float in the region behind the diaphragm, which considerable reduces the manufacturing and assembly costs of the mud saver valve.

Accordingly, it is an object of the invention to provide a mud saver valve having a pressurized flexible diaphragm which closes a mud flow passage in response to pressurized fluid applied behind the diaphragm, and opens in response to mud pumping pressure, and which can be used with very high mud pressures without damage to the diaphragm.

Another object is a mud saver valve with a diaphragm support having openings therein for flow of pressurized closing fluid, the opening taking the form of a clearance space with respect to a backup element behind the support so that at high mud pressure, the diaphragm material does not extrude through the clearance openings.

A further object is a mud saver valve in which the mud pressure is transmitted to the support by the diaphragm, there is a clearance space between the support and the back up for flow of pressurized valve closing fluid toward and away from the rear of the diaphragm, the support is arranged to deform or deflect toward the back up element to decrease the clearance space and thereby prevent the diaphragm from extruding through the flow passages into the region behind the support, and the support is configured to prop the diaphragm open away from the clearance space so that all gas can escape from between the diaphragm and its support.

A further object is a mud saver valve in which the pressurized gas flow passages take the form of an annular space between inner and outer rings surrounding the diaphragm.

A further object is a mud saver valve according to one or more of the above objects, in which the annular gas flow space is a clearance space between inner and outer rings which is sufficiently small that the diaphragm cannot enter and seal the space, but in which the inner ring(s) deflects or expands into engagement with the outer ring to close the clearance openings in response to high mud pressure acting on the diaphragm.

A further object is a mud saver valve according to one or more of the above objects in which the inner ring(s) is configured to prevent the diaphragm material from sealing the openings so that all gas behind the diaphragm can escape at high mud pressure.

A further object is a mud saver valve according to one or more of the above objects which is incorporated into a sub in which the pressurized valve closing fluid is sealed so that the sub requires no connections except to the kelley, the drill string or a well tool.

Other objects, features, and advantages of the invention will become apparent from the drawings, and the description which follows.

DETAILED DESCRIPTION

Figure 2:
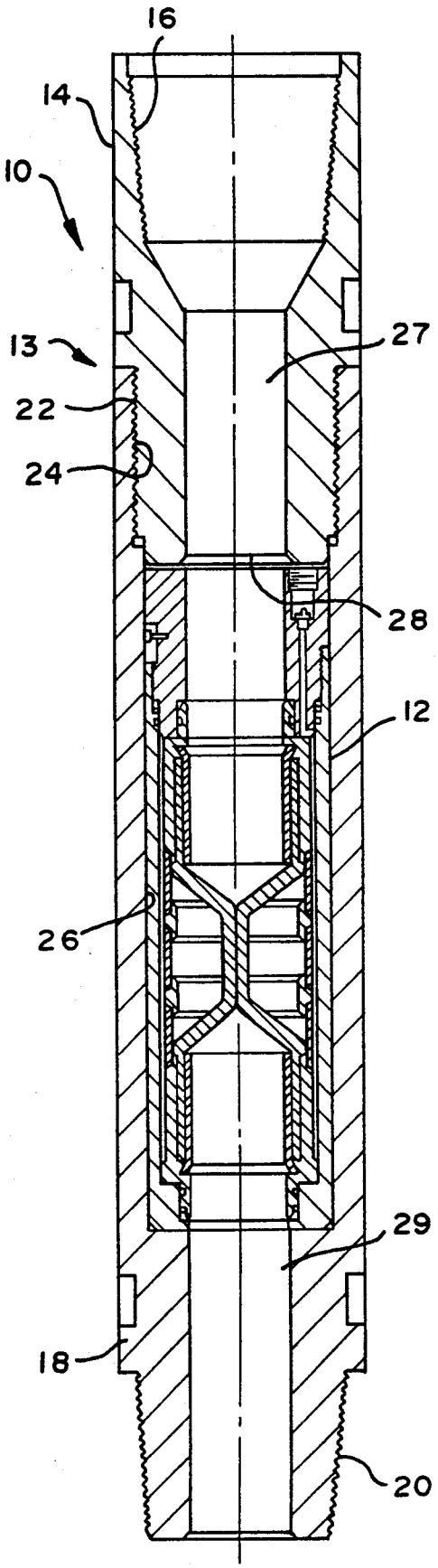
FIG. 2 is a view corresponding to FIG. 1 and showing the valve closed.
Figure 1:
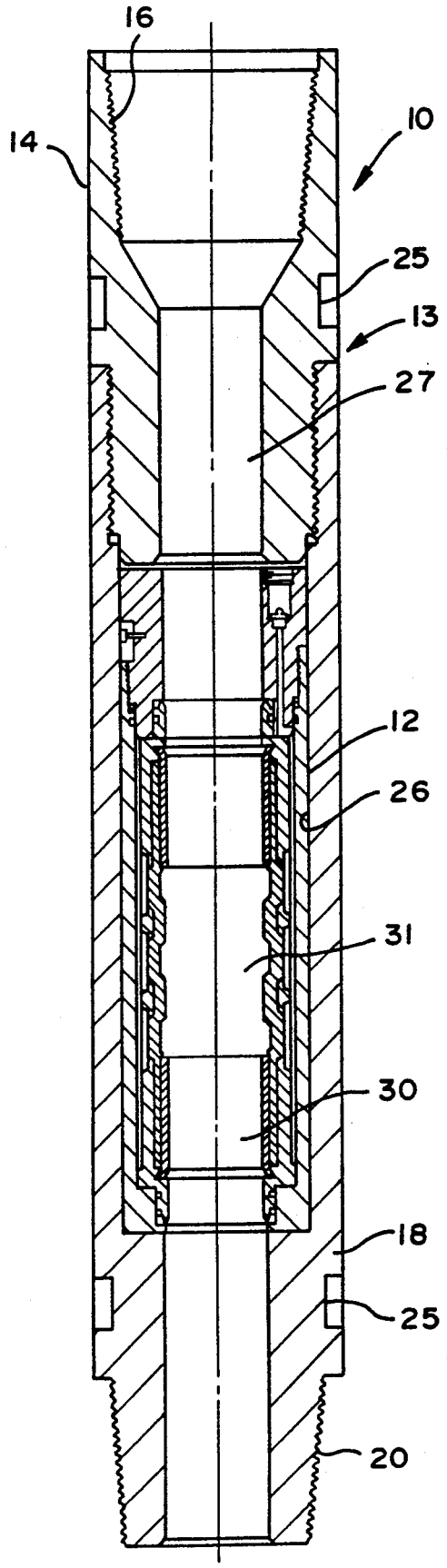
FIG. 1 is a view in longitudinal section of a sub containing the mud saver valve of the invention, and shows the valve open.

FIGS. 1 and 2 show a kelley or mud saver valve assembly 10 according to the invention. The assembly includes a removable capsule 12 which advantageously contains all the operating elements of the valve. The capsule 12 is housed in a sub 13 composed of an upper body 14 with an internally threaded box end 16 adapted to be connected to a kelley (not shown), and a lower body 18 with an externally threaded pin end 20 adapted to be connected to a drill string (not shown).

The upper body 14 has a male thread 22 which is screwed into a female thread 24 of the lower body 18 after the capsule 12 is inserted into the cylindrical interior 26 of the lower body 18. The capsule 12, upper body 14, and lower body 18 are so dimensioned that when the bodies are tightly threaded together, the capsule 12 is held against axial movement in sub 13. Assembly and disassembly is facilitated by providing wrench flats 25 in the upper and lower bodies.

Upper body 14 has a central flow passage 27 and a countersunk end 28 above capsule 12. Lower body 18 has a central flow passage 29.

FIG. 2 shows the valve in the closed position in which mud flow through the valve is blocked, and FIG. 1 shows the valve in the open position in which mud or other fluids can flow through the valve.

Capsule 12 has a central flow passage 30 aligned with the passages 27 and 29 when the sub 13 is assembled.

As will soon be described in greater detail, the valve element takes the form of a tubular flexible diaphragm 31 which forms a wall of the flow passage 30. The diaphragm 31 is forced to the closed position of FIG. 2 by pressurized gas in the region around or behind the diaphragm, and is forced to the open position of FIG. 1 by mud or other liquid or fluid in the flow passage 30 when the pressure in the passage is greater than the pressure of the gas behind the diaphragm.

Figure 3:
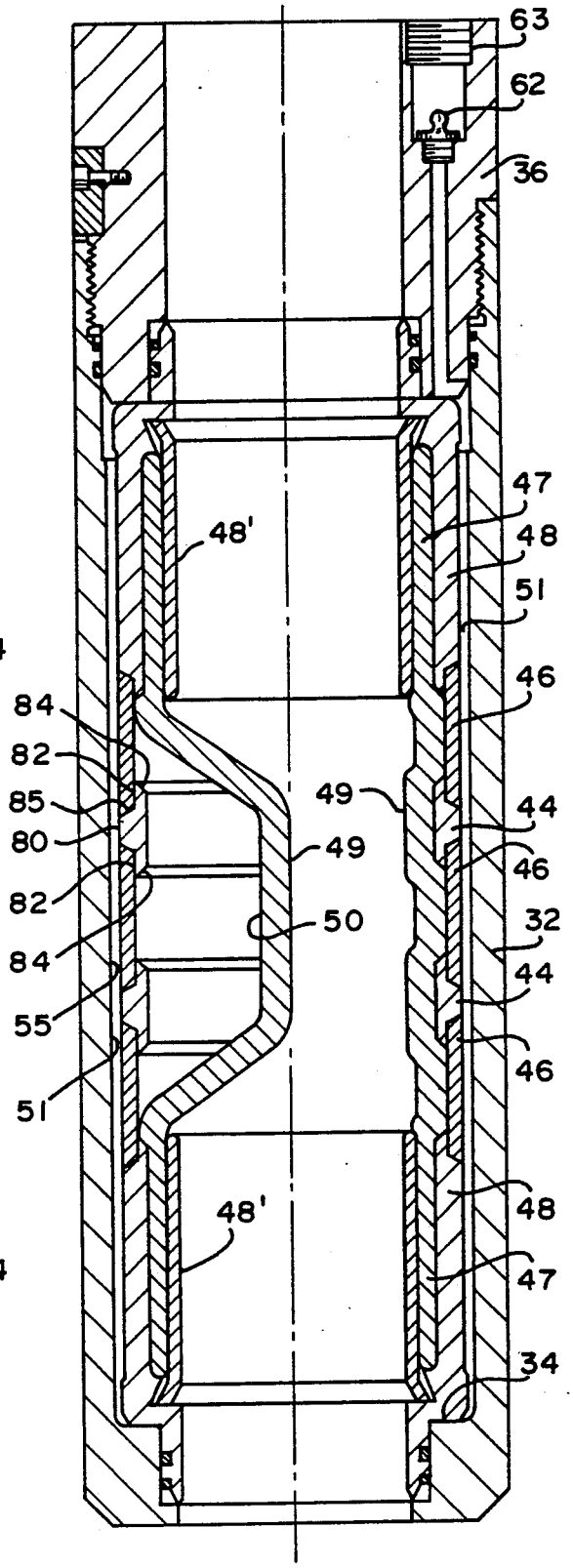
FIG. 3 is an enlarged view in longitudinal section showing details of the mud saver valve and its capsule, with the right hand side showing the diaphragm open, and left hand side showing the diaphragm closed.

As shown at FIG. 3, Capsule 12 includes an outer tubular body 32 with an inwardly extending flange 34 at one end, and an internal thread at the other end to receive a threaded annular upper end 36. Within the outer body 32 is a diaphragm assembly 38 which includes the tubular diaphragm 31 located within a diaphragm support in the form of a series of inner support sleeves or rings 44 and outer backup sleeves or rings 46. The respective ends 47 of the diaphragm are secured to tubular end members 48 by clamp sleeves 48' which are mechanically expanded to clamp the diaphragm ends to the end members so that the inner surface 49 of the diaphragm is sealed with respect to its outer surface 50.

The diaphragm assembly 38 is inserted in the outer body 32, and the end 36 is then threaded into the body. Suitable 0-ring seals and packing are provided to seal the pressurized gas containing region 51 between the outer surface 50 of the diaphragm and the inner surface 55 of the outer body 32.

As shown at FIG. 3, the support rings 44 and backup rings 46 have a smaller outer diameter than the inner diameter of body 32 to provide the annular pressurized gas containing region 51 outwardly of these rings. This region 51 is filled with gas under pressure through a filler fitting 62 in end 36 which is then closed with a plug 63 to retain the pressure.

Figure 4:
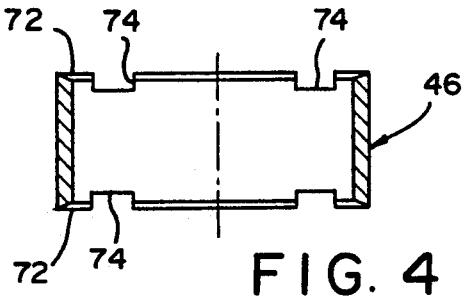
FIG. 4 is an axial view in section of a backup ring.

FIG. 4 shows a backup ring 46. Each backup ring 46 has countersunk or beveled end faces 72 cut at an acute angle to a diameter. The preferred angle is on the order of 20 to 25 degrees with respect to the diameter of the ring. A plurality of slots or notches 74 are formed in each end of a backup ring 46. In the preferred embodiment, four slots 74 are formed in each end of a ring 46 (only two being shown in the axial section of FIG. 4).

Each support ring 44 has a central generally trapezoidal outwardly extending portion 80 (as viewed in section at FIG. 3, ring shaped side portions 82, and beveled or countersunk ends 84. The trapezoidal portion 80 has sides 85 which slope at substantially the same angle as the beveled end faces 72 of the backup rings 46. The beveled ends of support rings 44 are preferable at an angle of 45 degrees.

The ring shaped side portions 80 of support rings 44 have a relaxed outer diameter slightly less than the inner diameter of backup rings 46 so alternate backup rings 46 and support rings 44 can be stacked on each other as shown at FIG. 3.

The axial length of each side portion 80 of a support ring from the trapezoidal center portion 80 to an adjacent end 84 is somewhat greater than the axial depth of the slots 74 in each backup ring 46, so that the side portions 80 of support rings 44 overlap the slots 74 as well as the ends of the adjacent backup rings 46.

Figure 5:
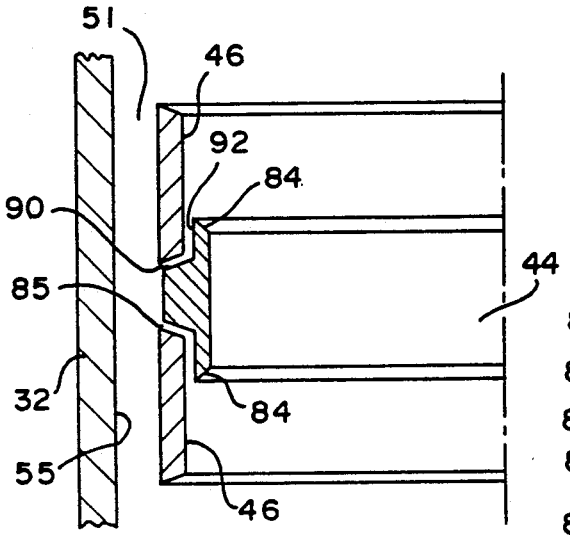
FIG. 5 is an enlarged partial view in longitudinal section with clearances exaggerated, to show the flow passages between rings for admitting and exhausting pressurized gas from the region behind the diaphragm.
Figure 6:
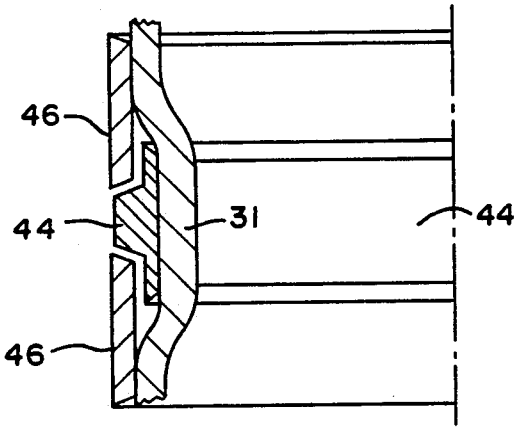
FIG. 6 is an enlarged partial view in section showing the manner in which the central portion of a support ring prevents premature sealing of gas flow clearance spaces by the diaphragm.

FIG. 5 shows the clearances between rings 44 and 46 exaggerated when the rings are relaxed, and the diaphragm is closed. In this condition, pressurized gas from the region 51 can flow into or out of the region between the rings and the rear of the diaphragm. The flow passages include the spaces 90 between the ends 72 of rings 46 and the sides 85, and the axial spaces 92 between the outer surface of sides 82 of rings 44 and the inner surface 94 of rings 46. The slots 74 in rings 46 cooperate with the axial spaces 92, to quickly exhaust the pressurized gas when well pressures within the diaphragm exceed the gas pressure and open the diaphragm.

As the pressure within the diaphragm increases and presses the diaphragm against the rings 44 and 46, the body of a ring 44 tends to space the diaphragm 31 away from the axial spaces 92 to thus enable substantially all the pressurized gas to escape from behind the diaphragm. This propping action is shown at FIG. 5.

The inner end of each end member 48 is like ½ of a support ring 44 to receive thereon an end of a backup ring 46. The stack of rings 44 and 46 essentially float, with sufficient axial clearance to allow the rings 44 to expand against and fully close the axial clearance spaces 92 when the pressure within the diaphragm is very high. The closing of the clearance space assures the absence of extrusion of the diaphragm material through the exhaust gas passages.

While the invention has been shown and described in the environment of a mud saver or Kelley valve, the valve can be used in any application where a self closing valve is required.

Changes and variations can be made without departing from the scope of the invention.

We claim:

1. In an automatically closing diaphragm valve having a diaphragm with inner and outer wall surfaces in which a pressurized fluid behind the wall of the diaphragm and acting on the outer surface of the diaphragm causes the diaphragm to deflect and close a flow passage defined at least in part by the inner surface of the wall of the diaphragm when the pressure in the passage is less than a predetermined value, and pressure in the flow passage above a predetermined value causes the diaphragm to deflect and exhaust the pressurized fluid from the region behind the diaphragm, the improvement comprising a backup element having a smooth surface for supporting the diaphragm, exhaust passage means defined by said backup element for allowing pressurized fluid to escape from between the diaphragm and the backup element in response to high pressure in said flow passage, and valve means between said diaphragm and said backup element for closing said exhaust passage means in response to pressure transmitted to the valve means by the diaphragm while maintaining the exhaust passage means smaller than the space into which the diaphragm can extrude at the pressure existing in the flow passage, said valve means including a portion projecting toward said diaphragm for holding said diaphragm away from said exhaust passage means to enable substantially all pressurized fluid behind the diaphragm to escape through said exhaust passage means.

2. A diaphragm valve according to claim 1 wherein, said diaphragm comprises a tubular diaphragm having an inner surface defining said flow passage and an outer surface facing toward said backup element, said backup element comprises at least one outer ring, and said valve means comprises at least one inner ring of an outside diameter slightly smaller than the inside diameter of the outer ring to define an annular space between said rings, said annular space comprising an inlet of said exhaust passage means, and pressure transmitted to said inner ring by said diaphragm elastically expands said inner ring toward said outer ring to decrease the size of the annular space as the pressure in the flow passage increases.

3. A diaphragm valve according to claim 2 wherein, said inner ring overlaps at least one gas escape opening in said outer ring and said opening is closed as said inner ring expands toward said outer ring.

4. A diaphragm valve according to claim 2 wherein, said inner ring comprises a wall with a beveled end for holding the diaphragm away from the annular space between the inner and outer rings.

5. A mud saver valve comprising, a tubular body having a flow passage therethrough, and being adapted to be connected to a well pipe, a flexible tubular diaphragm in said body forming a wall of the flow passage in the body along at least a portion of the length of the body, said diaphragm having an inner surface facing the flow passage, and an outer surface sealed relative to the inner surface, said diaphragm being responsive to well fluid pressure acting on said inner surface to open said flow passage, and being responsive to fluid pressure applied to said outer surface to collapse the diaphragm and close said flow passage when the pressure on said inner surface is below a predetermined value, at least two axially aligned relatively rigid backup rings surrounding said diaphragm and within said tubular body, a diaphragm support ring having an outer diameter slightly less than the inner diameter of said backup rings, means for maintaining said support ring axially between adjacent ends of said backup rings so that said support ring overlaps said backup rings, said support ring and backup rings defining an annular exhaust passage therebetween for the flow of pressurized fluid toward and away from said outer surface of the diaphragm, said annular exhaust passage presenting a space smaller than the space into which the material of the diaphragm can extrude when high fluid pressures act on said inner surface of said diaphragm.

6. A mud saver valve according to claim 5 wherein said diaphragm support sleeve comprises means responsive to the force exerted thereon by the diaphragm, when the pressure acting on the inner surface of the diaphragm exceeds a determined value, for elastically deforming toward said backup rings to reduce the radial space between the support ring and the backup rings.

7. A mud saver valve according to claim 6 wherein said diaphragm support sleeve comprises means responsive to pressure acting on said inner surface of the diaphragm for deforming into engagement with the backup element without exceeding the elastic limit of the diaphragm support.

* * * * *